US008663035B2

(12) United States Patent
Burgess

(10) Patent No.: US 8,663,035 B2
(45) Date of Patent: Mar. 4, 2014

(54) ROCKET TOSS

(76) Inventor: Michael Kent Burgess, La Habra, CA (US)

( * ) Notice: Subject to any disclaimer, the term of this patent is extended or adjusted under 35 U.S.C. 154(b) by 0 days.

(21) Appl. No.: 12/661,070

(22) Filed: Mar. 10, 2010

(65) Prior Publication Data

US 2010/0234143 A1 Sep. 16, 2010

Related U.S. Application Data

(60) Provisional application No. 61/159,348, filed on Mar. 11, 2009.

(51) Int. Cl.
*A63B 69/00* (2006.01)

(52) U.S. Cl.
USPC ..... 473/451

(58) Field of Classification Search
USPC ..... 473/417, 418, 451; 124/7, 49, 50, 79, 124/83
See application file for complete search history.

(56) References Cited

U.S. PATENT DOCUMENTS

| | | | | | |
|---|---|---|---|---|---|
| 2,955,823 | A * | 10/1960 | Chanko | 124/7 |
| 4,132,214 | A * | 1/1979 | Schnurr et al. | 124/1 |
| 4,676,504 | A * | 6/1987 | Ponza | 124/7 |
| 4,955,606 | A * | 9/1990 | Leps | 124/50 |
| 5,066,010 | A * | 11/1991 | Pingston | 473/451 |
| 5,097,985 | A * | 3/1992 | Jones | 221/86 |
| 5,232,218 | A * | 8/1993 | Leps | 124/50 |
| 5,292,119 | A * | 3/1994 | Norcross | 473/451 |
| 5,421,313 | A * | 6/1995 | Strayer | 124/1 |
| 5,558,324 | A * | 9/1996 | Jourdan | 124/83 |
| 5,573,252 | A * | 11/1996 | Simmons | 273/454 |
| 6,443,859 | B1 * | 9/2002 | Markin | 473/451 |
| 6,875,136 | B2 * | 4/2005 | Leal et al. | 473/451 |
| 6,974,396 | B2 * | 12/2005 | Mauer et al. | 473/417 |
| 7,214,147 | B2 * | 5/2007 | Gutierrez | 473/417 |
| 2007/0010353 | A1 * | 1/2007 | Huang | 473/417 |

* cited by examiner

*Primary Examiner* — Mark Graham

(57) ABSTRACT

A ball launching apparatus for batting practice having a ramp allowing an operator to propel a baseball or softball along the ramp such that it becomes airborne and may be batted by a batter. A plurality of the ramps may be connected together in a staggered fashion or used individually. Each of the ramps has two grooves, one within the other to accommodate a baseball or softball respectively.

11 Claims, 4 Drawing Sheets

ROCKET TOSS

This application claims the benefit of Provisional Patent No. 61/159,348 filed on Mar. 11, 2009 by it's present inventor which is incorporated by reference.

DESCRIPTION LIST

Figure 1:
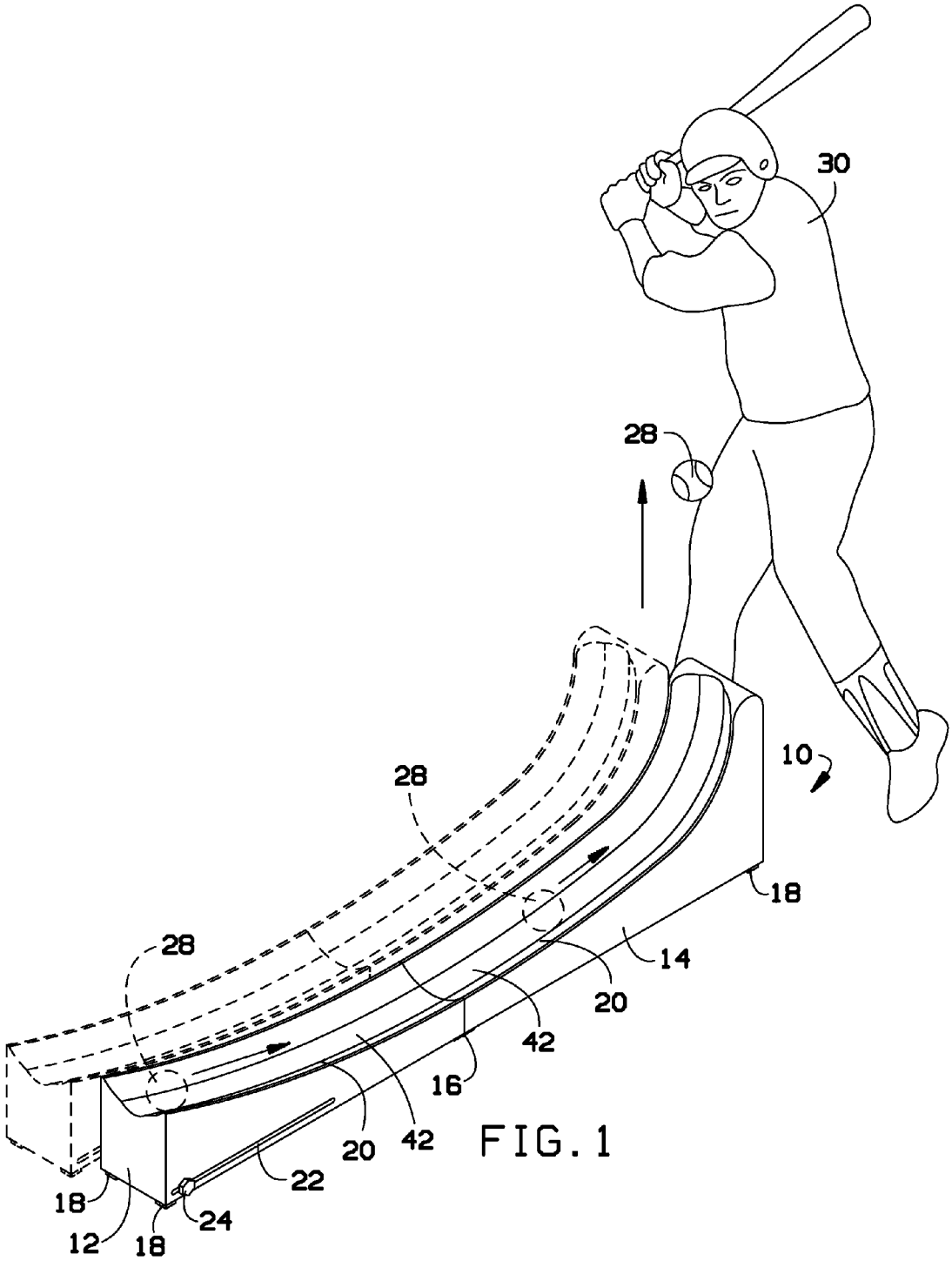
FIG. 1: is a perspective view of an exemplary embodiment of the invention illustrating an additional device attached in phantom.
Figure 2:
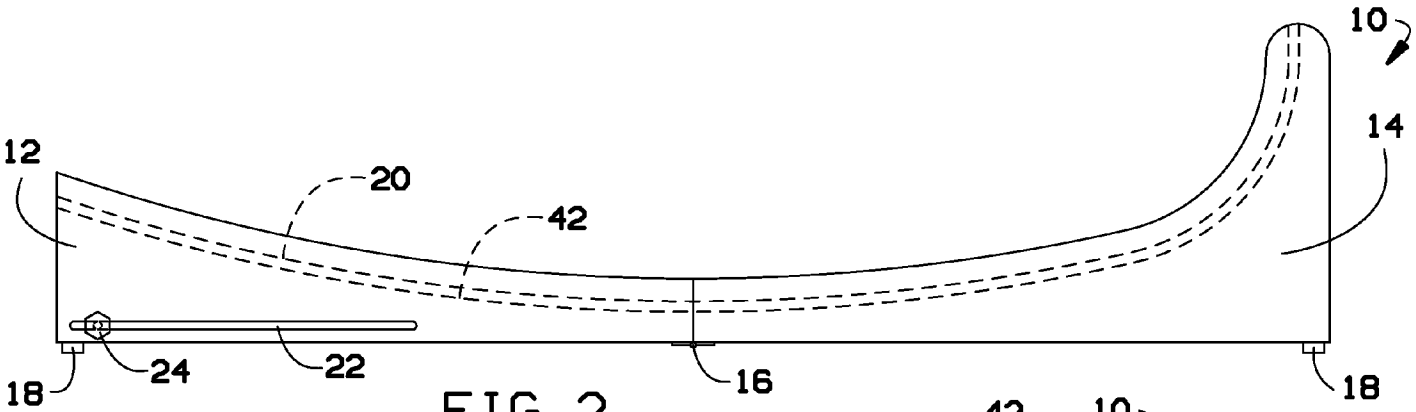
FIG. 2: is a side view the exemplary embodiment of the invention.
Figure 3:
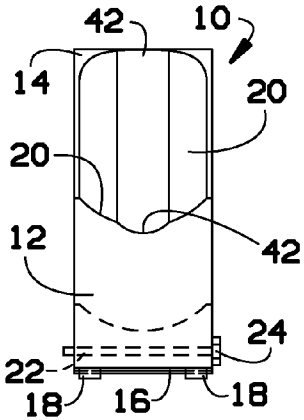
FIG. 3: is a front view of the exemplary embodiment the invention.
Figure 4:
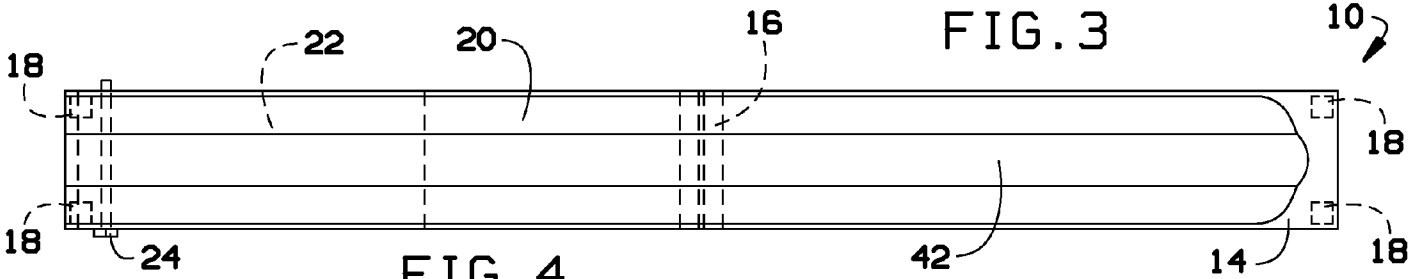
FIG. 4: is a top view of the exemplary embodiment the invention.
Figure 5:
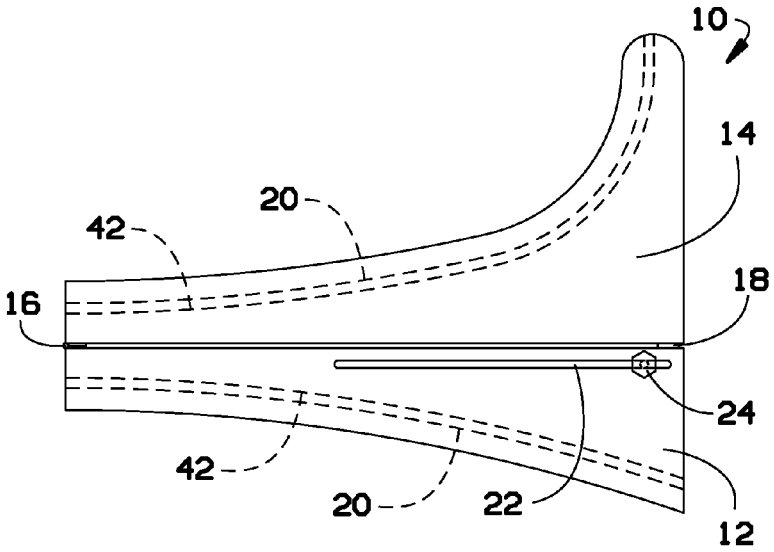
FIG. 5: is a side view of the exemplary embodiment the invention folded.
Figure 6:
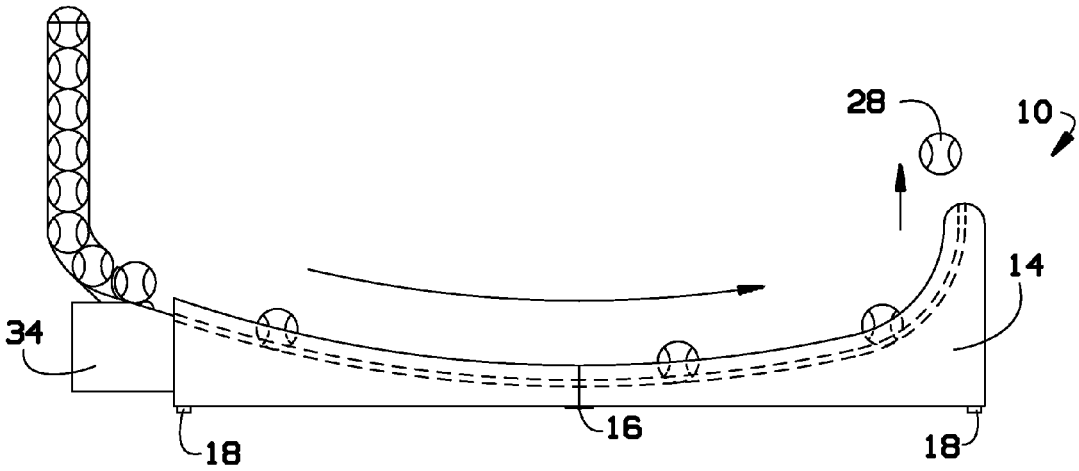
FIG. 6: is a side view of an alternative exemplary embodiment the invention.
Figure 7:
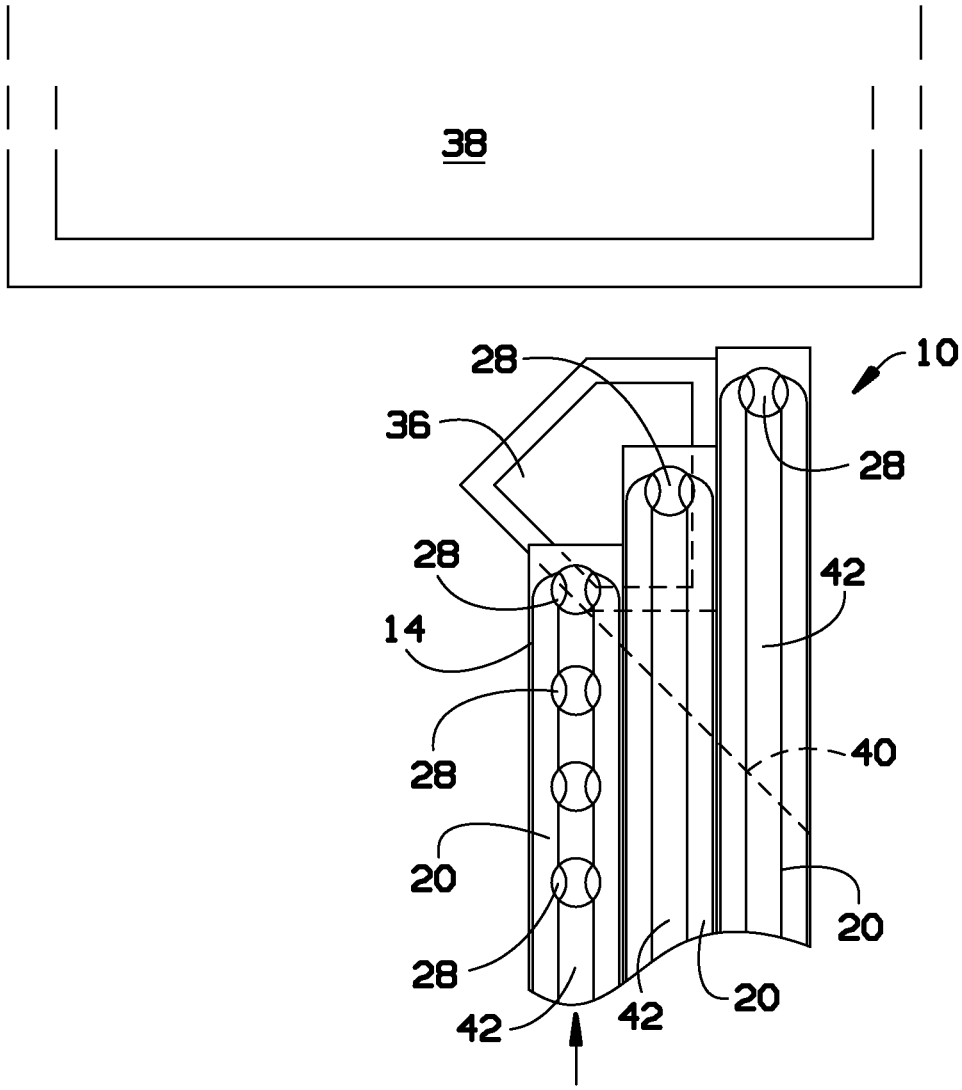
FIG. 7: is a top view of the embodiment of FIG. 4 illustrating positioning.

10: is the overall invention
12: is the downward sloping piece
14: is the upward sloping piece
16: is the hinge
18: are the adjustable pads
20: is the groove
22: is the slot
24: is the bolt
28: is the ball
30: is the batter
34: is the electrical motor with actuator
36: is home plate
38: is the batter's box
40: is the foul line
42: is the control groove

DETAILED DESCRIPTION OF THE INVENTION

The present invention relates to a device that is used for training baseball Hitters. This invention will cause the ball to rise above the plate in a spinning motion instead of being stationary. When used in conjunction with one or more devices of the same design would place spinning balls at different times and different locations above the plate. Without knowing which device or location is to be used next, the hitter cannot anticipate the location and change his/her stance or balance. The hitter must find a neutral stance and balance with which to hit balls of all locations within the strike zone. These devices would be adjustable as to location within the strike zone and across the plate, forward, rearward, and side to side. Height of the ball can be adjusted by the operator by using more or less effort to roll the ball through the device.

The invention has two or more parts. It is made of plastic, metal, or wood and hinged so that it can be folded to facilitate carrying. When unfolded it forms a rectangular box shape that is ground mounted. The operator sits next to the box at the entry end and rolls a ball in a groove along the top of it to the exit end. The device is 6 to 12 inches wide, 2 to 24 inches high, and is 50 to 80 inches long. The top edge of the rectangular box is irregularly shaped with both downward and upward slopes. There is a groove built into the top which helps maintain direction of the ball. The downward slope runs away from the operator and before it reaches the end of the rectangular box it curves upward 90 degrees to exit the ball. The downward curve nearest the operator facilitates the entry of the ball by reducing bounce and increasing momentum. The upward curve which is furthest from the operator takes the ball from its lowest point and redirects it upward where it is exited for the hitter to hit. There is a slot that runs through the width of the device near the bottom. This allows a long bolt to pass through it and allows the box to slide back and forth along the slot. This bolt would be lengthened by adding additional threaded shanks to it so that a single shank or bolt could pass through multiple devices. This will allow other devices of the same type to be mounted side by side and to adjust their locations by sliding them back and forth independently through their slots before being tightened into place. The device will have adjustable pads on the bottom to allow for uneven ground. It will also have a carrying handle and instructions.

A rectangular box sat on edge with a groove in the top with both downward and upward slopes. Adding an electrical motor with actuator could be added to propel the ball through the device instead of rolling it by hand.

The rocket toss comes in several pieces when connected together form a long rectangular box hinged so that it can be carried easily. The device has a groove in the top that cradles the ball when rolled from one end to the other. The top of the device has a surface that slopes downward from the operator and runs upward to the exit. Along the bottom of the device there is a slot which allows other devices of the same design to be bolted together and yet allow them to be adjustable forward and back independently then tightened so that they don't move.

The operator unfolds the device placing the exit end of that device near or on where home plate. The operator then places the entry end of the device in an area on the other side of home plate from where the hitter would be standing. This would be in or around the unoccupied batters box or could be in an area behind home plate normally where the umpire or catchers position would be. The operator from a sitting position beside the entry end of the device rolls a ball from that end down the device to the exit end over or near home plate. The ball then exits the device in an upward motion for the batter to hit. One or more of these devices can be used in different sequences to provide batting practice in multiple locations within the strike zone.

The rectangular box with groove and slopes would be made in at least two pieces and hinged so that it is easy to carry. If made of plastic it could be made by injection molding, rotational molding, fiberglass molding, or made of wood, or hand fabricated or cast from metal.

The device could be set on other devices of different sizes so as to change its delivery height or its delivery location.

The device is unfolded in an area where baseball or softball batting practice is to take place. The operator places the exit end on or near home plate. The operator then places the entrance end of the device in the opposing batters box across from where the hitter is standing. The operator then takes a sitting position beside the entrance point of the device. The operator then takes a ball and rolls it down the device similar to a Bowling movement to the exit end of the device where it exits in an upward motion for the batter to hit. The device can be moved around home plate so that different pitch locations can be practiced. Additional devices can be attached together side by side or placed in different locations to provide multiple pitch locations used in differing intervals.

What is claimed is:

1. A ball launching apparatus, comprising:

a base;

a ramp on the base including a front end and a back end, wherein the back end is curved upward substantially perpendicular to the base, wherein a first groove in the ramp includes a first radius sized to hold a softball, the groove configured to carry the softball along a length of the ramp, from the front end to, up and out of the back end; and a second groove in the ramp includes a second radius narrower than the first radius, the second groove positioned within the first groove along the length of the ramp, configured to carry the baseball along the length of the ramp, from the front end to, up and out of the back end.

2. The ball launching apparatus of claim 1 wherein, the front end is raised from the base, and the first and second grooves decline from the front end, toward the back end.

3. The ball launching apparatus of claim 1 wherein the back end is curved upward 90° from the base.

4. The ball launching apparatus of claim 1 further including an electrical motor to propel a ball along the ramp.

5. A ball launching system, comprising:

a plurality of ramps connected in juxtaposition with each other, the ramps each including a front end and a back end connected by parallel sides defining a width of the ramp, wherein the back end is curved upward substantially perpendicular to a base, and wherein each back end is staggered lengthwise from an adjacent back end when the ramps are connected to each other by a connector, wherein each of the plurality of ramps includes a slot through its width running partially along the length of the sides between the front and back ends, wherein the connector comprises a bolt passing through the slots of the connected ramps permitting the ramps to slide back and forth parallel to one another.

6. The ball launching system of claim 5, further comprising:

a first groove in the ramp including a first radius sized to hold a softball, the groove configured to carry the softball along a length of the ramp, from the front end to, up and out of the back end; and a second groove in the ramp including a second radius narrower than the first radius, the second groove positioned within the first groove along the length of the ramp, configured to carry the baseball along the length of the ramp, from the front end to, up and out of the back end.

7. The ball launching system of claim 5 wherein the back end of each ramp is curved upward 90° from the base.

8. The ball launching apparatus of claim 5 further including an electrical motor to propel a ball along the ramp.

9. A method of launching a baseball or softball for batting practice comprising the steps of:

providing a ball launching apparatus, comprising:

a base;

a ramp on the base including a front end and a back end, wherein the back end is curved upward substantially perpendicular to the base, wherein a first groove in the ramp includes a first radius sized to hold a softball, the groove configured to carry the softball along a length of the ramp, from the front end to, up and out of the back end; and a second groove in the ramp includes a second radius narrower than the first radius, the second groove positioned within the first groove along the length of the ramp, configured to carry the baseball along the length of the ramp, from the front end to, up and out of the back end, placing an operator next to the front end of the front end of the ramp, and propelling a baseball or softball along the ramp towards, and off, the back end of the ramp by the operator such that the baseball or softball becomes airborne and may be batted by a batter.

10. The method of claim 9 further comprising the operator using an electric motor to propel the baseball or softball.

11. The method of claim 9 further comprising:

providing a plurality of said apparatuses each including a said ramp wherein said ramps are connected in juxtaposition with each other, wherein the back end of each ramp is staggered lengthwise from an adjacent back end when the ramps are connected to each other.

* * * * *